US011994333B2

(12) United States Patent
Liberati et al.

(10) Patent No.: US 11,994,333 B2
(45) Date of Patent: May 28, 2024

(54) APPLIANCE FAN ASSEMBLY

(71) Applicant: WHIRLPOOL CORPORATION, Benton Harbor, MI (US)

(72) Inventors: Daniele Liberati, Pero (IT); Matteo Parnisari, Cassinetta (IT); Alessandro Mansutti, Cosano (IT); Dennis Ilare, Lainate (IT)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 253 days.

(21) Appl. No.: 17/528,449

(22) Filed: Nov. 17, 2021

(65) Prior Publication Data

US 2023/0152023 A1 May 18, 2023

(51) Int. Cl.

| | |
|---|---|
| ***F25D 17/06*** | (2006.01) |
| ***F04D 29/42*** | (2006.01) |
| ***F25D 17/04*** | (2006.01) |

(52) U.S. Cl.

CPC ..... *F25D 17/062* (2013.01); *F04D 29/4246* (2013.01); *F25D 17/045* (2013.01); *F25D 2317/0681* (2013.01)

(58) Field of Classification Search

CPC ..... F25D 17/062; F25D 17/045; F25D 2317/0681; F04D 29/4246

See application file for complete search history.

(56) References Cited

U.S. PATENT DOCUMENTS

| | | | |
|---|---|---|---|
| 6,957,549 | B2 | 10/2005 | Kim et al. |
| 10,571,183 | B2 | 2/2020 | Cheng et al. |
| 10,753,667 | B2 | 8/2020 | Zhu et al. |
| 10,935,302 | B2 | 3/2021 | Shi et al. |
| 2017/0336127 | A1 | 11/2017 | Fei et al. |
| 2018/0180345 | A1* | 6/2018 | Zhu ..... F04D 27/003 |
| 2018/0274840 | A1 | 9/2018 | Fei et al. |
| 2020/0284491 | A1 | 9/2020 | Zhu et al. |
| 2020/0355421 | A1 | 11/2020 | Fei et al. |

FOREIGN PATENT DOCUMENTS

| | | | |
|---|---|---|---|
| CN | 204404472 | U | 6/2015 |
| CN | 204404473 | U | 6/2015 |
| CN | 208588146 | U | 3/2019 |
| CN | 109556343 | A | 4/2019 |
| CN | 110530096 | A | 12/2019 |
| CN | 110906609 | A | 3/2020 |
| CN | 110906610 | A | 3/2020 |
| CN | 110906614 | A | 3/2020 |
| EP | 3428557 | B1 | 2/2021 |

(Continued)

*Primary Examiner* — Cassey D Bauer

(74) *Attorney, Agent, or Firm* — Brooks Kushman, P.C.

(57) ABSTRACT

A fan assembly including a housing, an impeller, a first damper member, a second damper member, and an actuation assembly. The housing defining a number of outlets and the impeller being configured to rotate about a rotational axis to direct air towards the number of outlets. The first damper member at least partially extending circumferentially about the impeller and the second damper member at least partially extend circumferentially about the impeller. The actuation assembly is configured to selectively rotate the first damper member and/or the second damper member to partially block, completely block or completely open the number of outlets.

17 Claims, 7 Drawing Sheets

(56) References Cited

FOREIGN PATENT DOCUMENTS

| | | | |
|---|---|---|---|
| WO | 2018040448 | A1 | 3/2018 |
| WO | 2018188644 | A1 | 10/2018 |
| WO | 2018128946 | A1 | 7/2019 |
| WO | 2018129246 | A1 | 7/2019 |
| WO | 2020238614 | A1 | 12/2020 |
| WO | 2020238616 | A1 | 12/2020 |

* cited by examiner

APPLIANCE FAN ASSEMBLY

TECHNICAL FIELD

The present disclosure relates to a fan assembly for use in household appliances such as refrigerators.

BACKGROUND

Refrigerators generally may include a fan assembly that controls or regulates the amount of cooled air provided to one or more compartments of the refrigerator. The fan assembly may be disposed in a cold air passage to maintain a desired temperature of each compartment. The fan assembly may include a frame provided with one or more openings or air passages that may route cooled air to the compartments and a damper that may be rotated by a motor to selectively open or close the air passages. The damper may be coaxially arranged between the fan and the frame and may move within a gap between the fan and the frame.

SUMMARY

According to one embodiment, a fan assembly for use in an appliance is provided. The fan assembly may include a housing, an impeller, a first damper member, a second damper member, and an actuation assembly. The housing may define a number of outlets and the impeller may be configured to rotate about a rotational axis to direct air towards the number of outlets. The first damper member may at least partially extend circumferentially about the impeller and the second damper member may at least partially extend circumferentially about the impeller. The actuation assembly may be configured to selectively rotate the first damper member and/or the second damper member to partially block, completely block or completely open the number of outlets.

According to another embodiment, an air supply device for use in a refrigerator is provided. The refrigerator may include a freezer compartment, a refrigerator compartment, and a convertible compartment. The air supply device may include an impeller, a first damper member, a second damper member, and an actuation assembly. The impeller may be configured to rotate about a rotational axis to provide direct air towards a number of outlets fluidly that may be connected to the freezer compartment, the refrigerator compartment, and the convertible compartment. The first damper member may include a first sidewall that may at least partially extend circumferentially about the impeller. The second damper member may at least partially extend circumferentially about the impeller and may be disposed radially between the impeller and the first damper member. The actuation assembly may be configured to selectively rotate the first damper member and/or the second damper member to partially block, completely block, or completely open at least one of the number of outlets.

According to yet another embodiment, a refrigerator is provided. The refrigerator may include a number of compartments, a panel, an impeller, a number of damper members, and an actuation assembly. The number of compartments may be formed by a number of mullions and walls of the refrigerator. The panel may be covered by one or more inner walls of the number of compartments. The panel may include a base surface and a number of protrusions that may collectively form a number of channels that may each be fluidly connected to one or more compartments of the number of compartments. The impeller may be rotationally coupled to the panel and configured to rotate about a rotational axis to direct air towards the number of outlets. The number of damper members may at least partially extend circumferentially about the impeller. The actuation assembly may be configured to selectively rotate the first damper member and/or the second damper member to partially block, completely block or completely open the number of channels.

DETAILED DESCRIPTION

Figure 1:
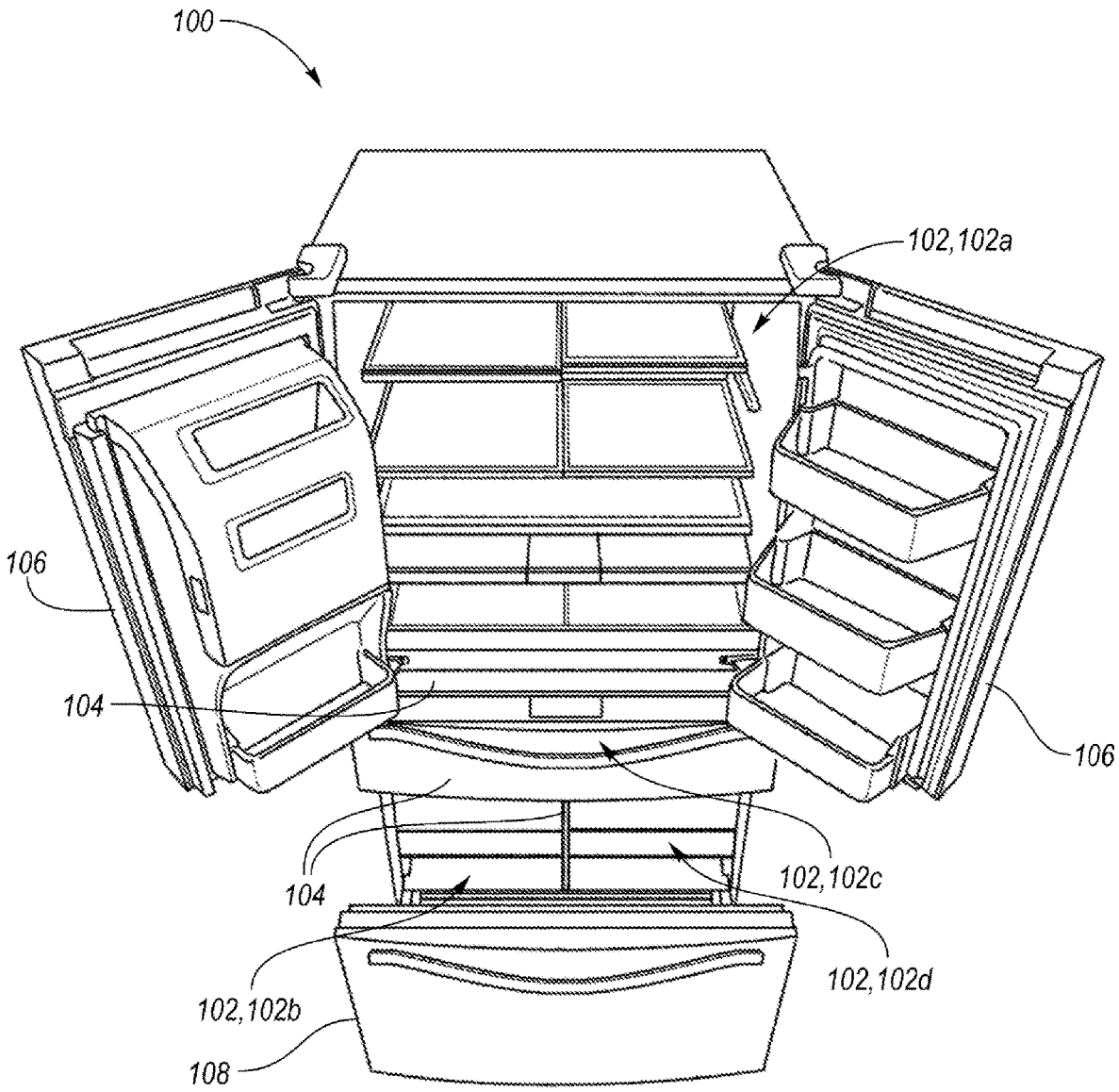
FIG. 1 illustrates a front-perspective view of an exemplary refrigerator.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

This invention is not limited to the specific embodiments and methods described below, as specific components and/or conditions may, of course, vary. Furthermore, the terminology used herein is used only for the purpose of describing particular embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIG. 1 generally shows the refrigerator 100. The refrigerator may be of the French-Door Bottom Mount type, but it is understood that this disclosure could apply to any type of refrigerator, such as a side-by-side, two-door bottom mount, or top-mount type. As shown in FIG. 1, the refrigerator 100 may include a number of storage compartments 102. The storage compartments may include a first internal storage chamber or a refrigerated compartment 102*a*, a convertible storage compartment 102*b*, and a freezer compartment 102*c*. The convertible storage compartment 102*b*, may be disposed between the refrigerator compartment 102*a* and the freezer compartment 102*c*. However, the compartments 102 may be arranged in a variety of arrangements. Each of the compartments 102 may be divided by a mullion or divider 104 configured to insulate the compartments from one another for independent temperature control. Additionally, one or more of the compartments 102 may be controlled to adjust in temperature such that the compartments 102 may be implemented to store frozen or fresh items.

Though the convertible compartment 102*b* is depicted in FIG. 1 as being positioned between the refrigerator compartment 102*a* and the freezer compartment 102*c*, a convertible compartment 102*d* may be implemented in a variety of configurations. For example, in some instances, the convertible compartment 102*d* may be arranged as a portion of the freezer compartment 102*c* and may be separated or divided by one of the mullions 104 or dividers to bisect the freezer compartment 102*c* or divide it into various proportions. In general, each of the compartments 102*a*-102*d* may be accessible via one or more doors. As shown, the fresh food compartment doors are designated 106, and the freezer door is designated 108. It may also be shown that the refrigerated compartment 102*a* may only have one door 106. As example, each of the compartments 102 divided by seals that may interact with the mullions 104 to insulate the compartments 102 from each other. Accordingly, the refrigerator 100 may be flexibly implemented in a variety of configurations.

The temperature of the convertible compartment 102*b* may be rapidly adjusted over a number of setpoints, which may range from approximately −25 degrees centigrade to 15 degrees centigrade. Such a temperature range may correspond to temperatures that may be implemented to store a variety of goods. However, other temperatures or ranges of temperatures may be implemented and achieved via a controller provided with a memory programmed to adjust the temperature of the convertible compartment 102*b*. As an example, the controller (not illustrated) may adjust one or more of the damper sidewalls to provide warm or cool air to the convertible compartment 102*b*.

Referring generally to the figures, a fan assembly 110 for use in the refrigerator 100 is provided. The fan assembly include a base member 112 that may be disposed on a wall 114 disposed behind or below one or more of the compartments 102. The base member 112 may define an opening in which a fan or impeller 120 extends through. The impeller 120 may be configured to rotate about a rotational axis R to direct warm or cool air to a number of outlets 124, 126, 128 that may each be fluidly connected to the compartments 102.

A number of deflectors 122 may extend from the base member 112 to form one or more ducts or outlets. As an example, the number of outlets may include a refrigerator outlet 124, that may be fluidly connected to the refrigerator compartment 102*a* to supply air from the impeller 120 to the refrigerator compartment 102*a*, a convertible compartment outlet 126, that may be fluidly connected to the convertible compartment 102*b* to supply air from the impeller 120 to the convertible compartment 102*b*, and a freezer outlet 128 that may be fluidly connected to the freezer compartment 102*c* to supply air from the impeller 120 to the freezer compartment 102*c*.

The fan assembly 110 may include a first damper member 116 and a second damper member 118. The first and second damper members 116, 118 may circumferentially extend about the impeller 120 and an actuation assembly 130 may be operatively connected to the first damper member 116, the second damper member 118, or both. The actuation assembly 130 may be configured to selectively rotate the first and second damper members 116, 118 to partially block, completely block, or completely open at least one of the number of outlets 124, 126, 128. Blocking one or more of the outlets 124, 126, 128, while opening the other outlets 124, 126, 128, may permit a volume of air that would have been otherwise provided to the other outlets so that the temperature of the compartments 102 fluidly connected to the outlets 124, 126, 128 may raised or lowered as desired in a relatively short period of time.

In one or more embodiments, the first damper member 116 may include a first annular ring 132 and a first damper sidewall 134 that may extend from the first annular ring 132 and the second damper member 118 may include a second annular ring 136 and a second damper sidewall 138 that may extend from the second annular ring 136. As an example, the first annular ring 132 may be spaced apart from the base member 112 and the second annular ring may lie along or move along the base member 112. The impeller 120 may include a number of vanes 140 and a band 142 that may extend between distal ends of each of the vanes 140 The distal ends of the vanes 140 and/or the band 142 may form an outer periphery of the impeller 120. The first sidewall 134 may be radially spaced apart from the outer periphery of the impeller 120 and the second sidewall 138 may be disposed radially between the first sidewall 134 and the impeller 120.

The first sidewall 134 may include a first circumferential portion 144 and a first tangential portion 146. The first circumferential portion 144 may be curved and may extend circumferentially about the outer periphery of the impeller 120 and the first tangential portion 146 may be substantially straight and extend in a substantially tangential direction with respect to the first circumferential portion 144. The second sidewall may include a second circumferential portion 148 and a second tangential portion 150. The second circumferential portion 148 may be curved and extend circumferentially about the outer periphery of the impeller 120 and the second tangential portion 150 may be substantially straight and extend in a substantially tangential direction with respect to the second circumferential portion 148. The first and second tangential portions 146, 150

The fan assembly 110 may include the number of deflectors 122 that may include a first deflector 122*a*, a second deflector 122*b*, and a third deflector 122*c*. The first deflector 122*a* and the second deflector 122*b* may form the refrigerator outlet 124. The first deflector 122*a* and a first end of the third deflector 122*c* may form the convertible compartment outlet 126 and a second end of the third deflector 122*c* and the second deflector 122*b* may form the freezer compartment outlet 128. The first and second deflectors 122*a*, 122*b* may be V-shaped and may include first and second arms 152, 154 that may be connected to one another by a curved portion 156. Alternatively or additionally, the third deflector may include a first distal portion 160, a second distal portion 162, and a medial portion 164 extending therebetween. As an example, the first and second distal portions 160, 162 may each be substantially straight and the medial portion 164 may be curved so as to circumferentially extend about an outer periphery of the impeller 120.

In one or more embodiments, the first and second damper members 116, 118 may be adjusted by one or more actuation assemblies. A first actuation assembly may include a first motor 226 and a first gear 228 that may be operatively coupled to the first motor 226. The first gear 228 may be spaced apart from the base member 112 and configured to engage one or more teeth 234 that may be formed by the first annular ring 132. A second actuation assembly may include a second motor 230 and a second gear 232 that may be operatively coupled to the second motor 230 and configured to engage one or more teeth 236 of the second annular ring 136.

Figure 2:
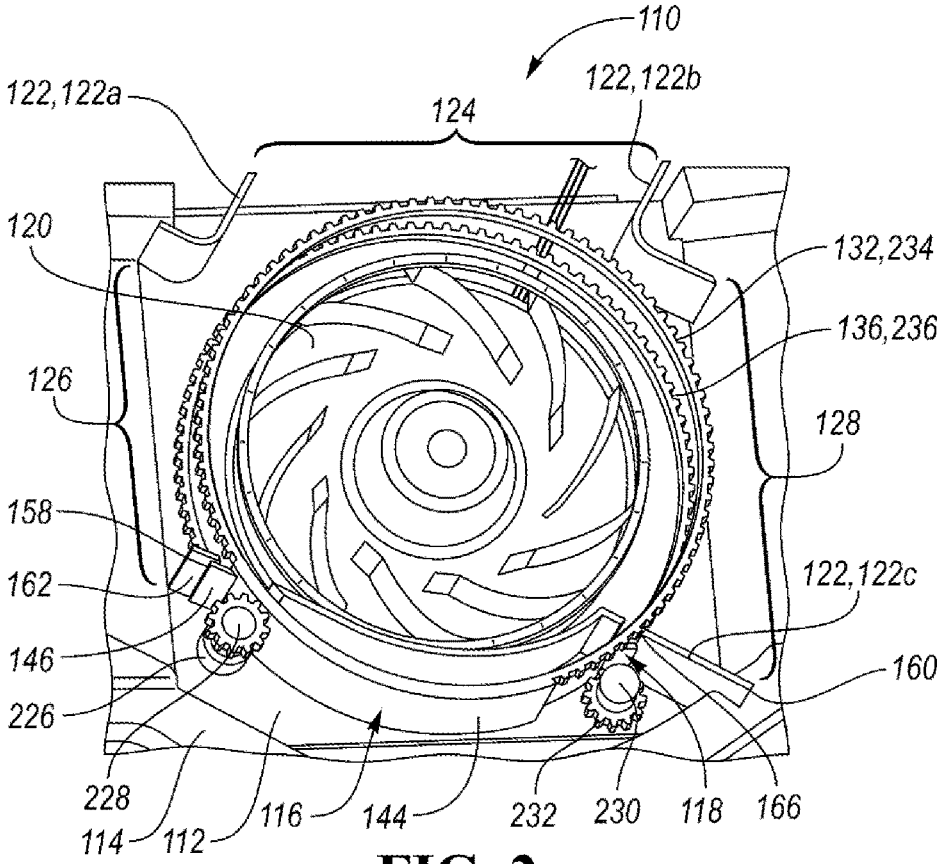
FIG. 2 illustrates a perspective view of an exemplary fan assembly provided with damper members in a first position.

FIG. 2 illustrates a perspective view of the fan assembly 110 according to one or more embodiments. The fan assembly 110 may include the impeller 120 and the first and second damper members 116, 118 may be disposed in a first position in which the first and second damper members 116, 118 do not block the refrigerator outlet 124, the convertible compartment outlet 126, or the freezer outlet 128 so that each of the outlets 124, 126, 128 are opened. In one or more embodiments, the first and second damper members 116, 118 may be arranged coaxial to one another, or concentric to one another, or both. The first damper member 116 may include the first annular ring 132 and the first sidewall 134 and the second damper member 118 may include the second annular ring 136 and the second sidewall 138. The annular rings 132, 136 may each have a rectangular shape that is bent to extend in the circumferential direction.

When the first and second damper members 116, 118 are in the first position, the first sidewall 134 may cover the second sidewall 138 in the radial direction. Alternatively or additionally, the first sidewall 134 and the second sidewall 138 may each cover the medial portion 164 in the radial direction. As an example, the first tangential portion 146 may lie against or be adjacent to the second distal portion 162 of the third deflector and the second tangential portion 150 may lie against or be adjacent to the first distal portion 160. In one or more embodiments, the first annular ring 132 may be disposed above the second distal portion 162 and the second annular ring 136 may extend below the second distal portion 162. As another example, the second distal portion 162 may define a slot 158 and the first and second damper members 116, 118 including the first annular ring 132, the first sidewall 134, the second annular ring 136, and the second sidewall 138 move in and out of. In one or more embodiments, the first distal portion 160 of the third deflector 122*c* may define a slot 166 and the first and second damper members 116, 118 including the first annular ring 132, the first sidewall 134, the second annular ring 136, and the second sidewall 138 may move in and out of the slot 166.

The first motor 226 and the first gear 228 and the second motor 230 and the second gear 232 may each be disposed adjacent to the third deflector 122*c*. However, the first and second motors 226, 230 and the first and second gears 228, 232 may each be coupled to the base member 112 in one or more other suitable positions so that the first and second gears 228, 232 may engage the teeth 234, 236 of the first and second annular rings 132, 136.

Figure 3:
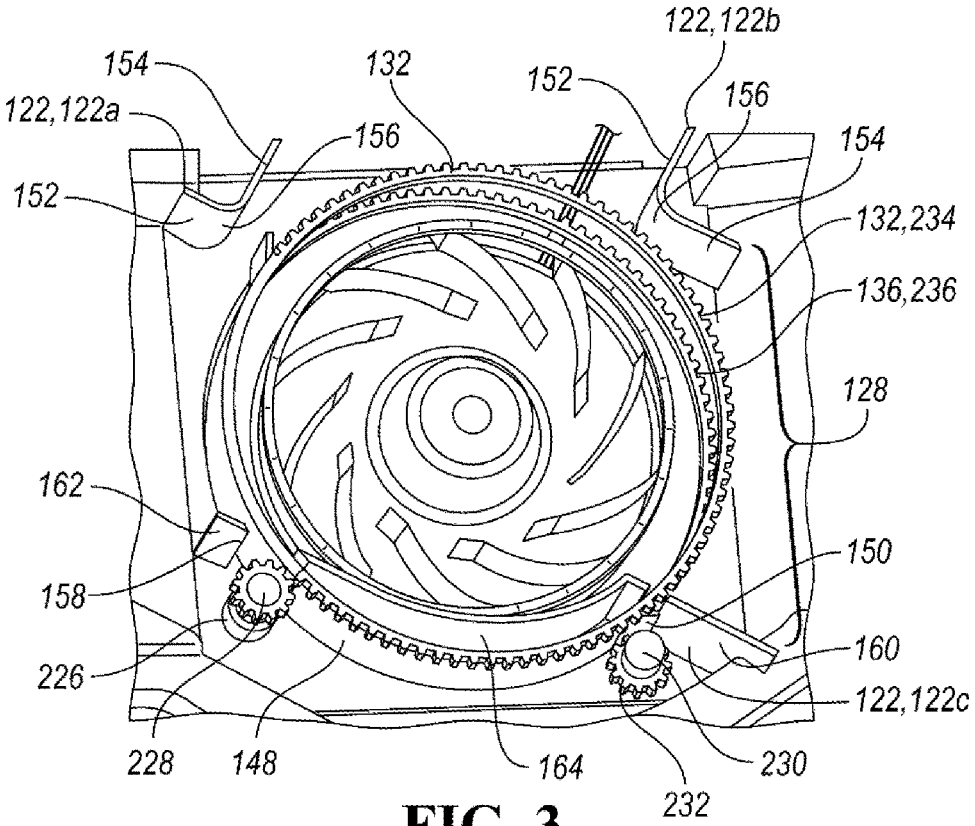
FIG. 3 illustrates a perspective view of the exemplary fan assembly provided with damper members in a second position.

FIG. 3 illustrates a plan view of the fan assembly 110 provided with the first and second damper members 116, 118 in a second position, in which the convertible compartment outlet 126 is closed and the refrigerator compartment outlet 124 and freezer compartment outlet 128 are each open. When the first and second damper members 116, 118 are in the second position, portions of the first sidewall 134 may at least partially overlap or cover the second sidewall 138. The first annular ring 132 may be disposed above, such as in the axial direction, and radially inward with respect to the second sidewall 138. The first tangential portion 146 may extend in a direction that is substantially parallel to the first deflection member 122*a* to direct air towards the second arm 154 and the refrigerator outlet 124. The first tangential portion 146 may be positioned to prevent or block air flowing to the convertible compartment outlet 126.

Figure 4:
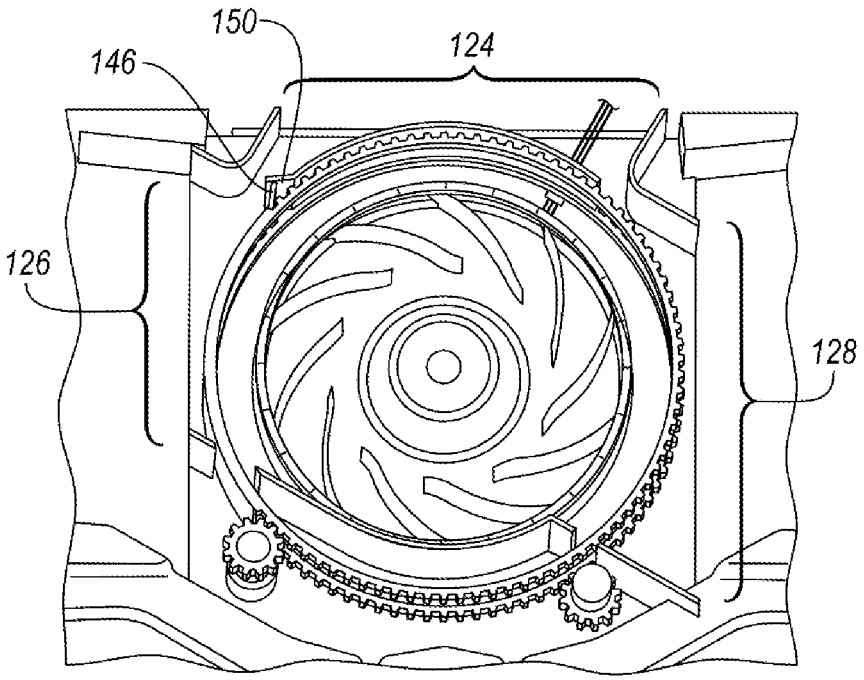
FIG. 4 illustrates a perspective view of the exemplary fan assembly provided with damper members in a third position.

FIG. 4 illustrates a plan view of the fan assembly 110 provided with the first and second damper members 116, 118 in a third position, in which the freezer compartment outlet 128 is open and the refrigerator outlet 124 and the convertible compartment 126 are closed. When the first and second damper members 116, 118 are in the third position, the first tangential portion 146 and the second tangential portion 150 may contact one another to close a gap disposed between the first circumferential portion 144 and the second circumferential portion 148. As an example, the second sidewall 138 may block the freezer compartment outlet 128 and the first sidewall 134 may block the convertible compartment outlet 126.

Figure 5:
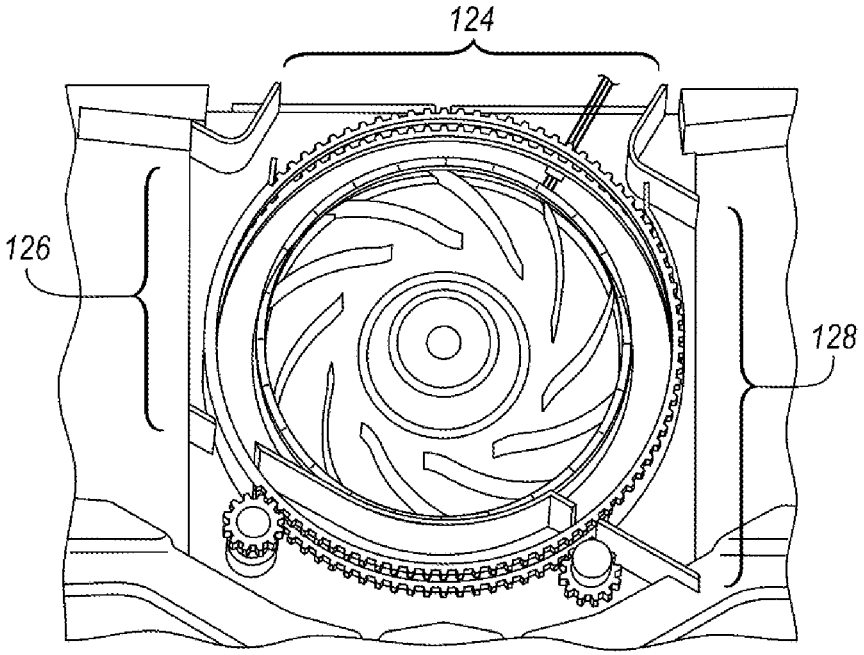
FIG. 5 illustrates a perspective view of the exemplary fan assembly provided with damper members in a fourth position.

FIG. 5 illustrates a plan view of the fan assembly 110 provided with the first and second damper members 116, 118 in a fourth position, in which the refrigerator compartment outlet 124 is open and the convertible compartment 126 and the freezer outlet 128 are each closed. As an example, the second sidewall 138 may block the freezer compartment outlet 127 and the first sidewall 134 may block the convertible compartment 126.

Figure 6:
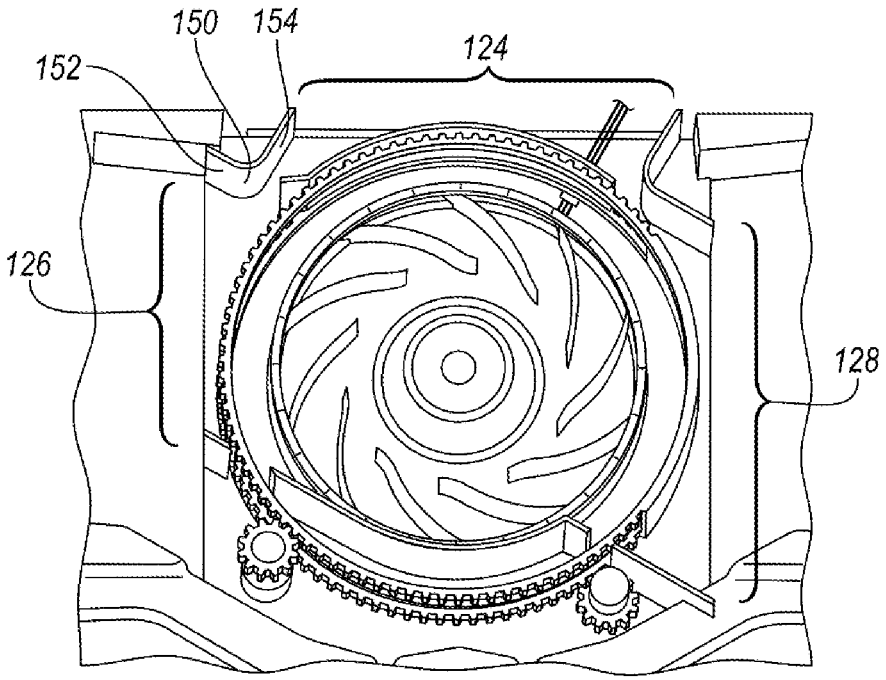
FIG. 6 illustrates a perspective view of the exemplary fan assembly provided with damper members in a fifth position.

FIG. 6 illustrates a plan view of the fan assembly 110 provided with the first and second damper members 116, 118 in a fifth position, in which the convertible compartment outlet 126 is open and the refrigerator compartment outlet 124 and the freezer outlet 128 are each closed. As an example, the second sidewall 138 may block the refrigerator compartment outlet 124 and the first sidewall 134 may block the freezer compartment outlet 128. The second tangential portion 150 may extend towards the curved portion 156 of the first deflector 122*a*. The second tangential portion 150 may be configured to direct air towards the first deflector 122*a* and the freezer compartment outlet 128.

Figure 7:
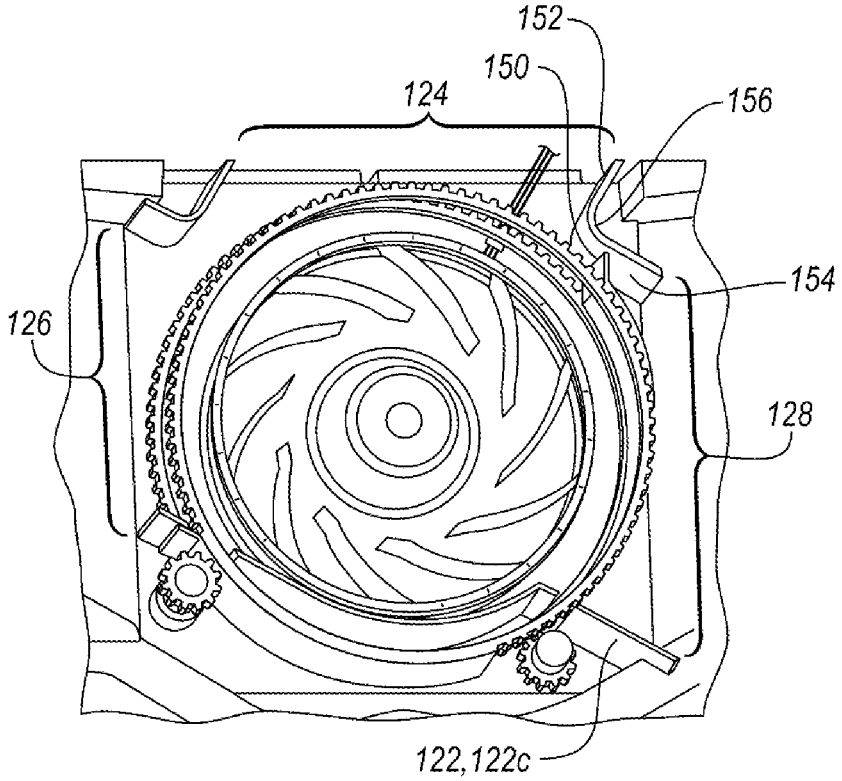
FIG. 7 illustrates a perspective view of the exemplary fan assembly provided with damper members in a sixth position.

FIG. 7 illustrates a perspective view of the fan assembly 110 provided with the first and second damper members 116, 118 in a sixth position, in which the convertible compartment outlet 126 and the refrigerator compartment outlet 124 are each open and the freezer compartment outlet 128 is closed. As an example, the second sidewall 138 may block the freezer compartment outlet 128 and the first sidewall 134 may be positioned to radially cover or overlap portions of the third deflector 122*c*. The second tangential portion 150 of the second sidewall 138 may extend towards the second arm 154 of the second deflector 122*b* so that air is directed towards the second deflector 122*b* and the refrigerator outlet 124.

Figure 8:
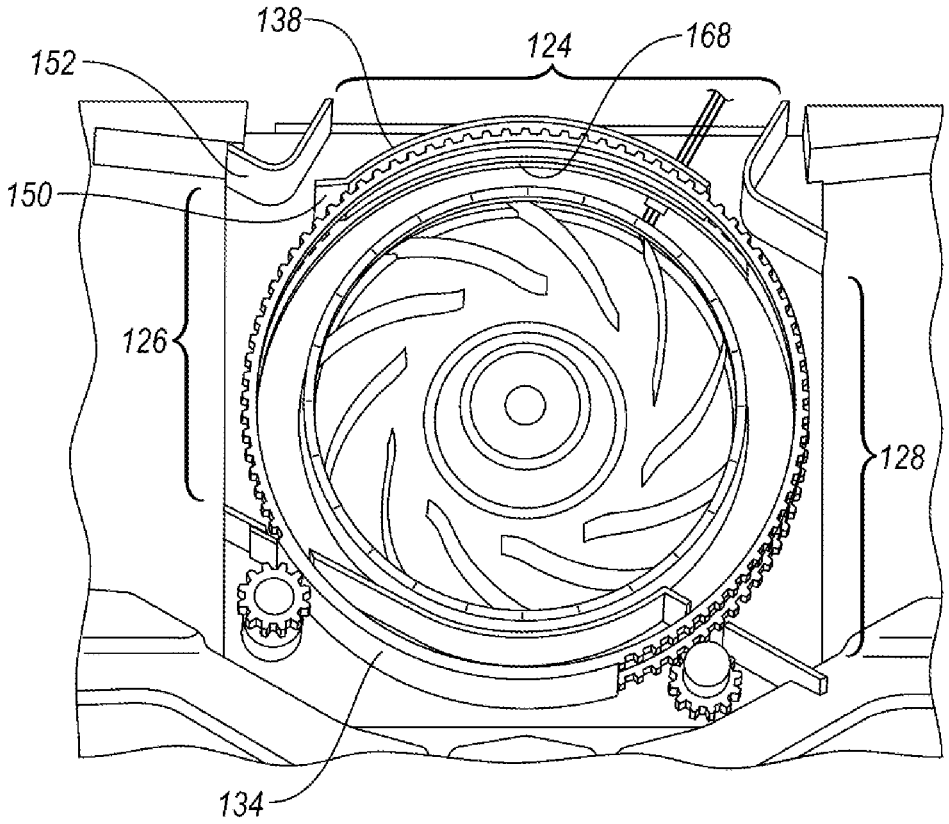
FIG. 8 illustrates a perspective view of the exemplary fan assembly provided with damper members in a seventh position.

FIG. 8 illustrates a perspective view of the fan assembly 110 provided with the first and second damper members 116, 118 in a seventh position, in which the convertible compartment outlet 126 and the freezer compartment outlet 128 are each open and the refrigerator compartment outlet 124 is closed. As an example, the second sidewall 138 may block the refrigerator compartment outlet 124 and the first sidewall 134 may be positioned to radially cover or overlap portions of the third deflector 122*c*. The second tangential portion 150 of the second sidewall 138 may extend towards or parallel to the first leg 153 of the first deflector 122*a* so that air is directed towards the first deflector 122*a* and the convertible compartment outlet 126.

In one or more embodiments, the second sidewall 138 may be spaced apart from an inner periphery 168 of the second annular ring 136.

Figure 9:
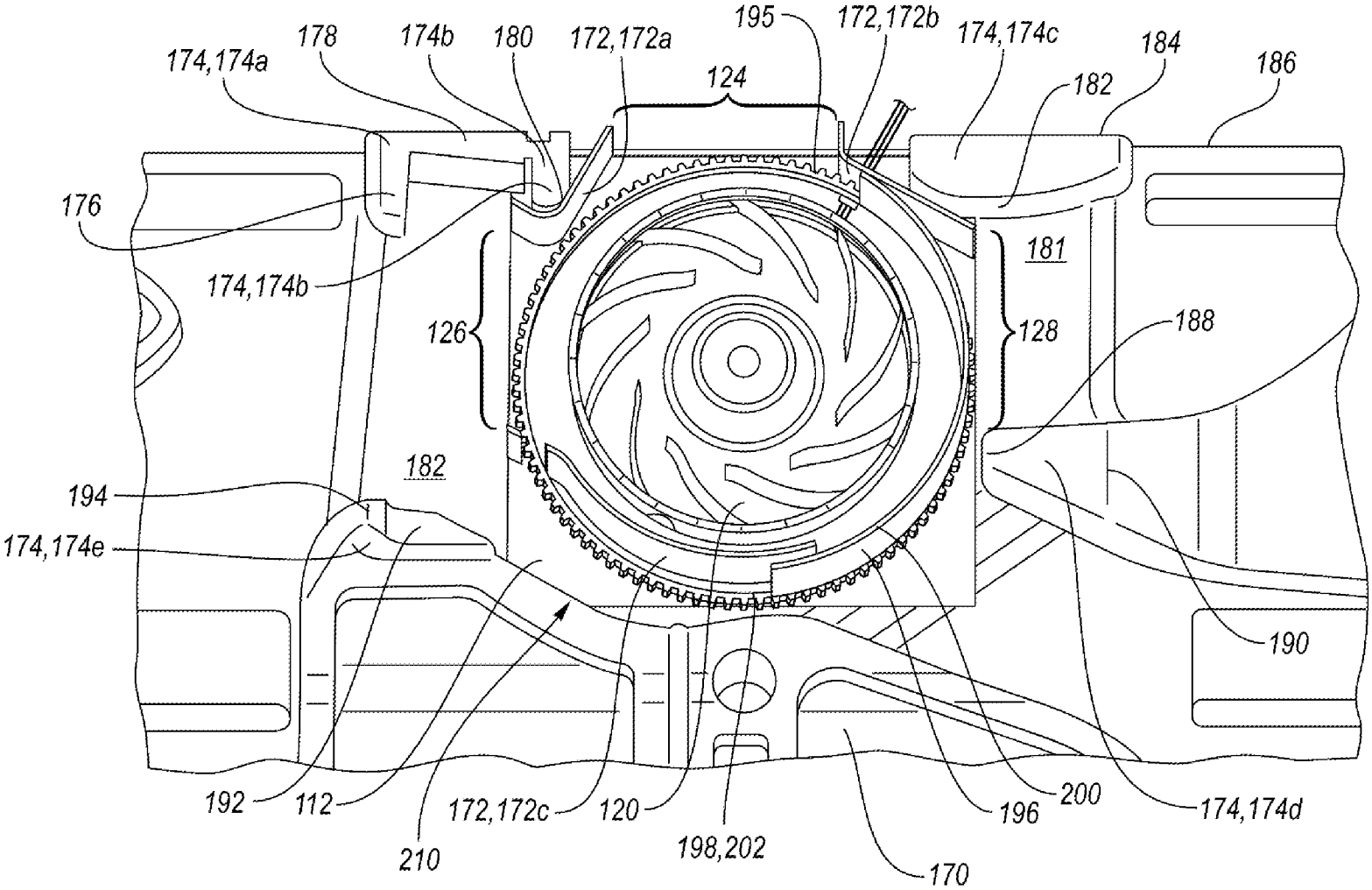
FIG. 9 illustrates a perspective view of another exemplary fan assembly.

FIG. 9 illustrates a perspective view of a portion of the refrigerator 100 that includes a panel 170 and an exemplary fan assembly 210. The base member 112 may be disposed on the panel 170 and the impeller 120 may be rotationally coupled to the panel 170 and extend through the base member 112. A number of deflectors 172 may be fixed to the base member 112 to form the refrigerator compartment outlet 124, the convertible compartment outlet 126, and the freezer compartment outlet 128. As an example, the number of deflectors 172 may include a first deflector 172*a*, a second deflector 172*b*, and a third deflector 172*c*.

The panel 170 may include a number of protrusions 174 and the number of protrusions 174 and the number of deflectors 172 may collectively form the refrigerator compartment outlet 124, the convertible compartment outlet 126, and the freezer compartment outlet 128. As an example, the number of protrusions may include a first protrusion 174*a* that may include a first segment 176 and a second segment 178 that may be arranged substantially orthogonally to the first segment 176. The first segment 176 may form an inner periphery of the refrigerator outlet compartment 126 and may include an inner surface and an outer surface, the inner surface spaced closer to the impeller 120 than the outer surface. As an example, the outer surface may be curved, and the inner surface may be relatively straight. The curved outer surface may be configured to mitigate or prevent turbulent air flow through the refrigerator compartment outlet 126.

A second protrusion 174*b* may be disposed between the first deflector 172*a* and the first protrusion 174*a*. For example, the second protrusion 174*b* may be connected e.g., integrally formed to the first protrusion 174*a*. The second protrusion 174*b* may include a curved surface 180 that may be adjacent to or contact the first deflector 172*a*. The first and second protrusions 174*a*, 174*b* may be spaced on a first side of the refrigerator compartment outlet 124 and a third protrusion 174*c* may be disposed on a second side of the refrigerator compartment outlet 124. The third protrusion 174*c* may have a flat-bottom airfoil shape provided with a curved inner surface, 182 that may face the impeller 120, and a flat surface that may form or face an outer periphery 186 of the panel 170.

In one or more embodiments, the panel 170 may include a fourth protrusion 174*d* that may be spaced apart from the third protrusion 174*c* away from the outer periphery 186. As an example, the fourth protrusion may have a substantially triangular shape including a vertex 188 and a base 190. The vertex 188 may be disposed closer to the impeller 120 than the base 190. The panel 170 may include a fifth protrusion 174*e* that may be spaced apart from the first protrusion 174*a* on the other side of the convertible compartment outlet 126. As an example, the fifth protrusion 174*e* may include a first section 192, that may extend in a direction that is parallel to the second section 178 of the first protrusion 174*a*, and a second section 194 that may extend substantially orthogonally to the first section 194.

The protrusions 174 may form one or more channels 181, 182, 195 that may be fluidly connected to the outlets 124, 126, 128. The third protrusion 174*c* and the fourth protrusion 174*d* may form a first channel 181 that may be fluidly connected to the freezer compartment outlet 126. The second protrusion 174*b* and the third protrusion 174*c* may collectively form a second channel that may be fluidly connected to the refrigerant compartment outlet 124. The first protrusion 174*a* and the fifth protrusion 174*e* may form a third channel 182 that may be fluidly connected to the convertible compartment outlet 126.

A damper member 196 may be rotationally fixed to the base 112 and configured to selectively rotate to partially block, completely block or completely open the number of outlets 124, 126, 128. The damper member 196 may include an annular ring 198 and a sidewall 200 that may extend from an inner periphery 202 of the annular ring.

Figure 10:
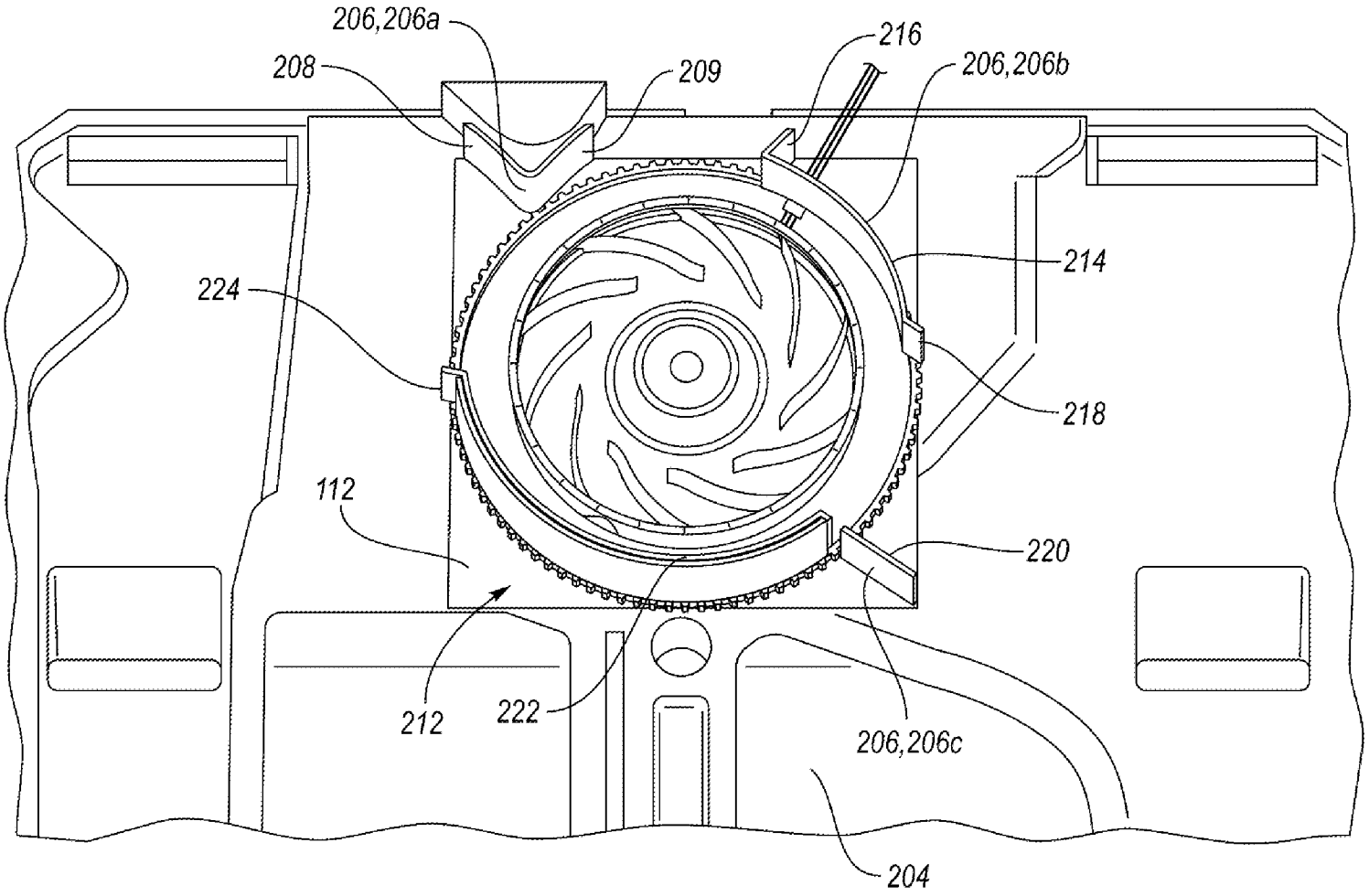
FIG. 10 illustrates a perspective view of another exemplary fan assembly.

FIG. 10 illustrates a perspective view of a portion of the refrigerator 100 that includes an exemplary panel 204 and an exemplary fan assembly 212. One or more deflectors 206 may extend from the base member 112, including a first deflector 206*a*, a second deflector 206*b*, and a third deflector 206*c*. As an example, the first deflector 206*a* may include a first leg 208 and a second leg 209 that may extend orthogonally the first leg 208. The second deflector 206*b* may include a curved portion 214, a first radial extending portion 216, and a second radial extending portion 218. The first and second radial extending portions 216, 218 may each extend from ends of the curved portion 214. The third deflector 206*c* may include a first radial extending portion 220, a second radial extending portion 224, and a curved portion 222 that may extend therebetween.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fan assembly for use in an appliance including a housing defining a number of outlets, the fan assembly comprising:

an impeller configured to rotate about a rotational axis to direct air towards the number of outlets;

a first damper member at least partially extending circumferentially about the impeller;

a second damper member at least partially extending circumferentially about the impeller;

an actuation assembly configured to selectively rotate the first damper member and/or the second damper member to partially block, completely block or completely open the number of outlets; and a base member, wherein the impeller is disposed on the base member and the first damper member includes a first annular ring and a first sidewall, wherein the first annular ring is spaced apart from the base member and the first sidewall extends from the first annular ring towards the base member, wherein the second damper member includes a second annular ring and a second sidewall and wherein the second sidewall is disposed radially inward from the first sidewall.

2. The fan assembly of claim 1, wherein the second annular ring lies along the base member and the second sidewall extends from the second annular ring.

3. The fan assembly of claim 2, wherein the first sidewall is radially spaced apart from an outer periphery of the impeller.

4. The fan assembly of claim 1, wherein the actuation assembly is configured to rotate the first damper member and the second damper member to an open position, in which the second sidewall radially covers the first sidewall.

5. The fan assembly of claim 3, wherein the first sidewall includes a first portion and a second portion, wherein the first portion extends in a circumferential direction with respect to an outer periphery of the impeller and the second portion extends in a first tangential direction tangential to the circumferential direction.

6. The fan assembly of claim 4, wherein the second sidewall includes a first portion and a second portion, wherein the first portion extends in the circumferential direction and the second portion extends in a second tangential direction tangential to the circumferential direction.

7. The fan assembly of claim 6, wherein the actuation assembly is configured to rotate the first damper member and the second damper member to a first position, in which the first damper member blocks a first outlet of the number of outlets and the second damper member blocks a second outlet of the number of outlets, and the second portion of the first sidewall and the second portion of the second sidewall contact one another.

8. An air supply device for use in a refrigerator including a freezer compartment, a refrigerator compartment, and a convertible compartment, the air supply device comprising:

an impeller configured to rotate about a rotational axis to direct air towards a number of outlets fluidly connected to the freezer compartment, the refrigerator compartment, and the convertible compartment;

a first damper member including a first sidewall at least partially extending circumferentially about the impeller;

a second damper member at least partially extending circumferentially about the impeller and disposed radially between the impeller and the first damper member; and an actuation assembly configured to selectively rotate the first damper member and/or the second damper member to partially block, completely block or completely open at least one of the number of outlets; and a base member, wherein the impeller is disposed on the base member, and the first damper member includes a first annular ring spaced apart from the base member, and wherein the first sidewall extends from the first annular ring towards the base member.

9. The air supply device of claim 8, wherein the second damper member includes a second annular ring and a second sidewall, wherein the second annular ring lies along the base member and the second sidewall extends from the second annular ring.

10. The air supply device of claim 8, further comprising:

a number of deflectors collectively arranged to form the number of outlets, wherein a first deflector of the number of deflectors defines a slot in which the first sidewall moves along as the first damper member rotates.

11. The air supply device of claim 10, wherein the first deflector includes a first distal portion, a second distal portion, and a medial portion extending therebetween, wherein one of the first or second distal portions define the slot.

12. The air supply device of claim 11, wherein the medial portion is curved and the first and second distal portions are substantially straight.

13. The air supply device of claim 8, wherein the first damper member extends circumferentially about an entire circumference of the impeller.

14. A refrigerator comprising:

a number of compartments formed by a number of mullions and walls of the refrigerator;

a panel covered by one or more inner walls of the number of compartments, wherein the panel includes a base surface and a number of protrusions collectively forming a number of channels each fluidly connected to one or more compartments of the number of compartments;

an impeller rotationally coupled to the panel and configured to rotate about a rotational axis to direct air towards the number of outlets; and a first damper member and a second damper member, each at least partially extending circumferentially about the impeller;

an actuation assembly configured to selectively rotate the first damper member and/or the second damper member to partially block, completely block or completely open the number of channels; and a base member, wherein the impeller is disposed on the base member, and the first damper member includes a first annular ring and a first sidewall, the first annular ring spaced apart from the base member, and wherein the first sidewall extends from the first annular ring towards the base member.

15. The refrigerator of claim 14, wherein a first protrusion and a second protrusion of the number of protrusions collectively form a first channel of the number of channels, wherein the first and second protrusions each have flat portion and a curved portion collectively forming a flat-bottom airfoil shape.

16. The refrigerator of claim 15, wherein the second protrusion and a third protrusion form a second channel of the number of channels, wherein the second protrusion has a substantially triangular shape.

17. The refrigerator of claim 16, wherein the third protrusion includes a vertex and a base, and the vertex is disposed closer to the impeller than the base.

* * * * *